United States Patent [19]

Anderson

[11] Patent Number: 4,621,444

[45] Date of Patent: Nov. 11, 1986

[54] SHELL DEFLECTOR ATTACHED TO THE RECIPROCABLE BOLT OF A FIREARM

[76] Inventor: Darryl P. Anderson, 7630 St. Clair Ave., North Hollywood, Calif. 91605

[21] Appl. No.: 592,264

[22] Filed: Mar. 22, 1984

[51] Int. Cl.[4] ..... F41C 27/00

[52] U.S. Cl. ..... 42/98

[58] Field of Search ..... 42/1 T

[56] References Cited

U.S. PATENT DOCUMENTS

| | | | |
|---|---|---|---|
| 3,270,617 | 9/1966 | Seymour et al. | 42/1 T |
| 3,603,015 | 9/1971 | Jensen | 42/1 T |
| 3,609,900 | 10/1971 | Bernocco, Jr. | 42/1 T |
| 3,733,728 | 5/1973 | Kuslich | 42/1 T |
| 3,978,602 | 9/1976 | Morrow et al. | 42/1 T |
| 3,984,932 | 10/1976 | Morton | 42/1 T |

FOREIGN PATENT DOCUMENTS

| | | | |
|---|---|---|---|
| 312918 | 6/1919 | Fed. Rep. of Germany | 42/1 T |

*Primary Examiner*—Charles T. Jordan

[57] ABSTRACT

The deflector is for use with semi-automatic firearms. It is attached to the reciprocable bolt of the firearm and takes the place of the operating handle.

As the shell is being automatically ejected from the firearm, it's path of flight is altered when striking the deflector. The flight path of the deflected shell is changed from a sideward direction to a forward direction. This deflective action also reduces the distance the ejected shell travels.

6 Claims, 7 Drawing Figures

SHELL DEFLECTOR ATTACHED TO THE RECIPROCABLE BOLT OF A FIREARM

SUMMARY OF THE INVENTION

This invention relates generally to firearms and is particularly concerned with a device for deflecting spent cartridges or shells as they are ejected from the firearm.

The deflector device will effectively deflect every ejected shell to a point forward of the firearm, regardless of the type of shell being fired.

The shell deflector can be made from metalic or plastic materials and is of a one piece construction.

It is the object of this invention to deflect the ejected shells from a semi-automatic firearm to an area forward of the shooting position.

In recent years new types of shell cartridges have been developed; some are made of non-metalic materials, such as plastic, and some shells have very short brass bases. The different types of shells eject in different directions due to material and design differences. This shell deflector device will force the ejected shells to an area forward of the firearm and will reduce the distance the ejected shell will travel.

DETAILED DESCRIPTION

Figure 1:
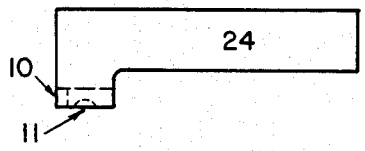
FIG. 1 shows a side view of the deflector 24 with a notched 10 and a recessed 11 area.
Figure 2:
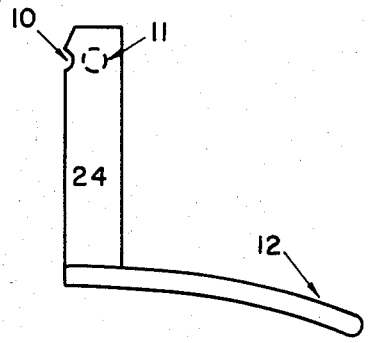
FIG. 2 shows a top view of the deflector 24 with the notched 10 and recessed 11 area and the point of deflection 12.
Figure 3:
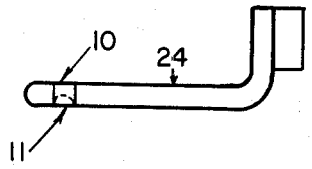
FIG. 3 shows a rear view of the deflector 24 with the notched 10 and recessed 11 areas.
Figure 4:
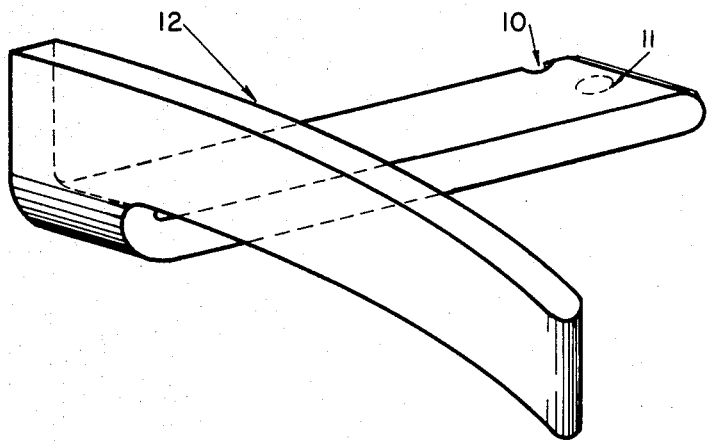
FIG. 4 shows a perspective view of the deflection 24 a notched 10, and ressed 11 area and the deflection area 12.
Figure 5:
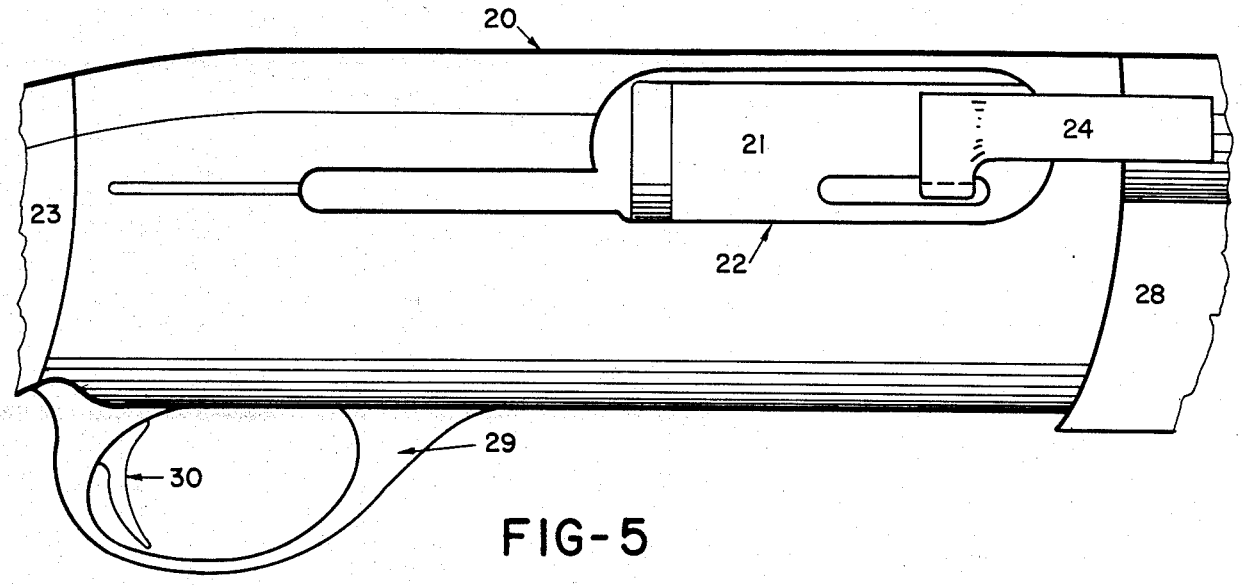
FIG. 5 shows a side view of a firearm with a cut-away view of the stock 23. The forearm 28 the trigger housing 29, the trigger 30. The ejection port 22 the bolt 21 is in a closed position, the receiver 20 and the deflector 24 is inserted into the bolt.
Figure 6:
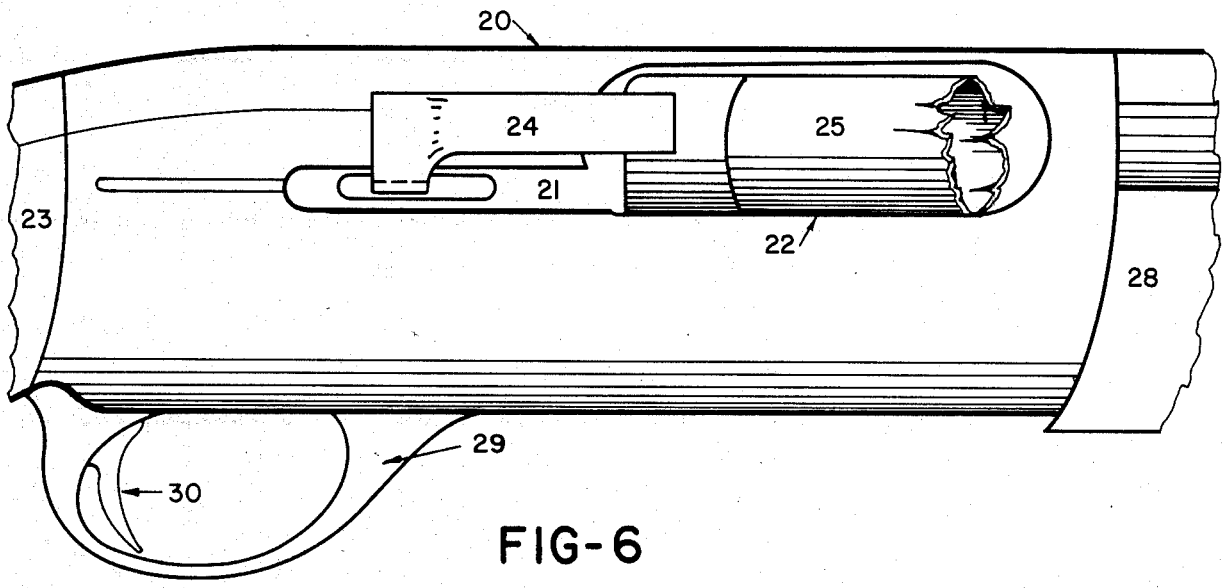
FIG. 6 shows a side view substantially the same as in FIG. 5 with the bolt 21 in an open position with the shell 25 exposed.
Figure 7:
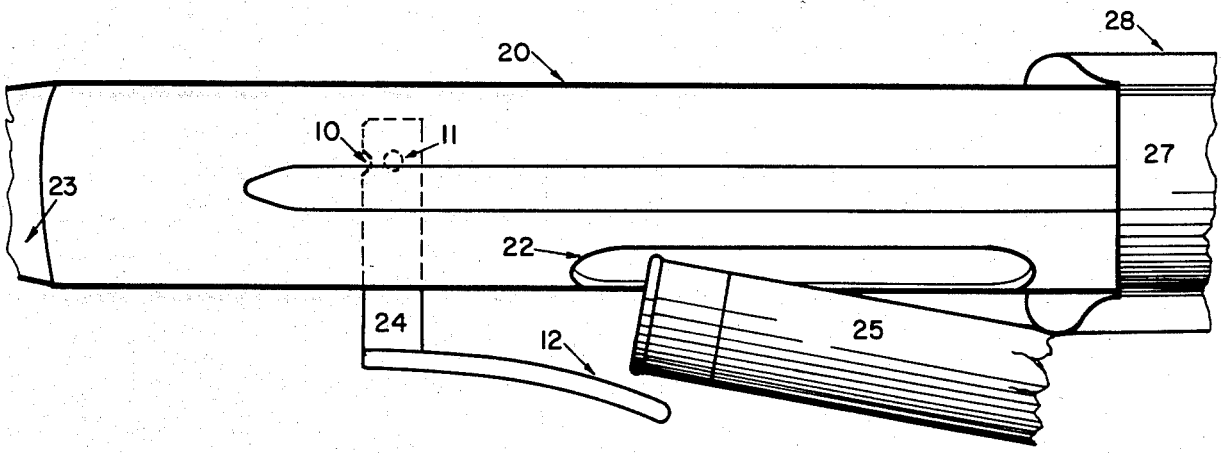
FIG. 7 shows a top view of a firearm with the shell 25 being ejected through the ejection port 22 about to strike the deflector 24 on the deflection surface 12.

As shown in drawing figures 1, 2, 3, 4, 5, 6 and 7 the deflector 24 is made form one piece of material, metallic or non-metallic. It is formed in a manner that allows it to be inserted into the reciprocable bolt 21 of a semi-automatic firearm; taking the place of the operating handle.

After the gun fires the spent shell casing 25 is extracted from the chamber and ejected from the ejection port 22 with the rearward motion of the reciprocable bolt 21. As the shell 25 leaves the ejection port 22, it strikes the deflector 24; this contact with the deflector

24 at the point of deflection 12 causes the flight path of the shell 25 to change from a sideward angle to a forward angle. This deflection process occures every time the gun is fired.

What is claimed is:

1. In combination; a firearm having a laterally opening ejection port through which a spent shell is ejected, a reciprocable bolt having a shell ejector mechanism operable upon rearward movement of said bolt, and a bolt handle opening for receiving an outwardly extending bolt handle for manually operating the reciprocable bolt and shell ejector mechanism; and a deflector device mounted on said bolt in said bolt handle opening in place of said bolt handle wherein said deflector device moves with said bolt and has a portion extending forwardly of said bolt adjacent said ejection port such that an ejected shell upon exiting said firearm strikes said deflector device and is deflected in a forward direction.

2. The combination as claimed in claim 1, wherein said deflector device has a recess and notched portion for receipt in said bolt handle opening so that said deflector device also functions as a bolt handle.

3. In combination; a firearm having a receiver with a laterally opening ejection port through which a spent shell is ejected, a reciprocable bolt having a shell ejector mechanism operable upon rearward movement of said bolt, and a bolt handle opening for receiving an outwardly extending bolt handle for manually operating the reciprocable bolt and shell ejector mechanism; and a deflector device mounted on said bolt in said bolt handle opening in place of said bolt handle, wherein said deflector device moves with said bolt and has a portion extending parallel to and forwardly of said bolt and adjacent said ejection port such that an ejected shell upon exiting said firearm strikes said forwardly extending deflector portion and is deflected in a forward direction.

4. The combination as claimed in claim 3, wherein said deflector device has a recess and notched portion for receipt in said bolt handle opening so that said deflector device also functions as a bolt handle.

5. In combination; a repeating firearm having a receiver with a laterally opening ejection port through which a spent shell is ejected, a reciprocable bolt having a shell ejector mechanism operable upon rearward movement of said bolt, and a bolt handle opening for receiving an outwardly extending bolt handle for manually operating the reciprocable bolt and shell ejector mechanism; and a deflector device mounted on said bolt in said bolt handle opening in place of said bolt handle, wherein said deflector device moves with said bolt and has a portion extending parallel to and forwardly of said bolt adjacent said ejection port such that an ejected shell upon exiting said firearm strikes said forwardly extending deflector portion and is deflected in a forward direction.

6. The combination as claimed in claim 5, wherein said deflector device has a recess and notched portion for receipt in said bolt handle opening so that said deflector device also functions as a bolt handle.

* * * * *